US006633125B2

(12) United States Patent
Smith et al.

(10) Patent No.: US 6,633,125 B2
(45) Date of Patent: Oct. 14, 2003

(54) SHORT WAVELENGTH INFRARED CATHODE

(75) Inventors: Arlynn Walter Smith, Blue Ridge, VA (US); Rudolph George Benz, Daleville, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 155 days.

(21) Appl. No.: 09/871,509

(22) Filed: May 31, 2001

(65) Prior Publication Data

US 2002/0180343 A1 Dec. 5, 2002

(51) Int. Cl.[7] ..... H01J 40/06
(52) U.S. Cl. ..... 313/542
(58) Field of Search ..... 313/498, 499, 313/501, 506, 507, 542, 543, 544, 530, 531, 532, 523, 524, 373, 375, 384, 385, 386, 387, 388

(56) References Cited

U.S. PATENT DOCUMENTS

| | | | | |
|---|---|---|---|---|
| 3,814,993 A | * | 6/1974 | Kennedy | 357/30 |
| 5,047,821 A | | 9/1991 | Costello et al. | 357/30 |
| 5,404,026 A | * | 4/1995 | Mariella, Jr. et al. | 257/10 |
| 5,712,490 A | * | 1/1998 | Smith | 257/11 |
| 6,069,445 A | | 5/2000 | Smith | 313/541 |
| 6,121,612 A | | 9/2000 | Sinor et al. | 250/330 |

OTHER PUBLICATIONS

"Integration of Microstructures Onto Negative Electron Affinity Cathodes: Fabrication and Operation of an Addressable Negative Electron Affinity Cathode" by Adval J.P. Santos and Noel C. MacDonald, J. Vac. Sci. Technol. B, vol. 11, No. 6, Nov./Dec. 1993.

"Selective Emission of Electrons From Patterned Negative Electron Affinity Cathodes" Edval J.P. Santos, IEEE Transactions Electron Devices, vol. 41, No. 3, Mar. 1994.

* cited by examiner

*Primary Examiner*—Vip Patel
*Assistant Examiner*—Jason Phinney
(74) *Attorney, Agent, or Firm*—Duane Morris LLP

(57) ABSTRACT

A cathode structure for an image intensifier tube operates to extend the spectral range of an image intensifier to the short wavelength infrared (SWIR) range of the electromagnetic spectrum, which is between 1.0 to 1.75 $\mu$m. The cathode structure utilizes a multi-layer structure consisting of a layer of GaSb disposed upon a layer of GaAs. The layers form a heterojunction therebetween where the GaSb material absorbs radiation and the GaAs is for emission characteristics. The doping profiles in each material are used to maximize the effects of band gap offsets of the heterojunction as well as provide a nearly flat conduction band profile for the cathode structure. The condition of nearly flat conduction band is enhanced by the use of blocking contacts at the emission surface of the cathode, where a bias is applied.

10 Claims, 5 Drawing Sheets

SHORT WAVELENGTH INFRARED CATHODE

FIELD OF THE INVENTION

The present invention relates to a cathode, and more particularly, to a photocathode particularly for use in an image intensifier and having a short wavelength infrared response.

BACKGROUND OF THE INVENTION

Photocathode devices are optic electronic detectors which employ the photo emissive effect to respond to light. When photons impinge on the surface of the cathode, the impinging photons cause electrons to be emitted from the cathode. Many photocathode devices are made from semiconductor materials, such as gallium arsenide (GaAs). While GaAs is preferred, it is noted that other III–V compounds can be used such as, gallium phosphide (GaP), gallium indium arsenide phosphide (GaInAsP), indium arsenide phosphide (InAsP), as well as others. Essentially, visible light and near infrared (NIR) cathodes based on gallium arsenide materials have been available for many years. These cathodes in conjunction with microchannel plates (MCPs) and phosphor screens are utilized in high efficiency light amplification systems. These systems are employed in state of the art image intensifier tubes or devices. Such devices are utilized by the military and in many other applications. In addition to extremely high efficient light amplification, the resolution of these systems is greater than that of pixilated designs based on charge coupled devices (CCDs) and CMOS based sensors (APS). There is a great deal of investigation in regard to lower light level solid state image sensors, based on silicon technology. This work is continuing and strives to advance the spectral range of detection further into the NIR compared to gallium arsenide based technology. Pixilated designs and other material systems, in order to directly extend the spectral range are being proposed, but they do not have the resolution compared to current silicon technologies.

Many advances are being made in detector technology regarding silicon readout and the state of the art is improving, especially in the area of microbolometers. This pushes the spectral range further to the mid and far infrared wavelengths. In any event, this technology does not offer an alternative for producing high resolution, direct or indirect view options, with the spectral range in the short wavelength infrared (SWIR) portion of the electromagnetic spectrum.

The present invention depicts a cathode design capable of imaging the SWIR region of the electromagnetic spectrum, while retaining the advantages of the gallium arsenide based technology utilized in modern image intensifiers. The resulting technology can be used in a direct view system or coupled to a commercial CCD device to provide a versatile SWIR system as a SWIR intensified CCD. Previous attempts at extending the spectral range of image intensifiers relied on a direct substitution of the cathode materials. For example, silicon was substituted for GaAs or InGaAs for GaAs.

In any event, in certain instances the substitutions provided acceptable negative infinity devices (Si or InP to a lesser degree). However, in the case of silicon, an unacceptable cathode thickness is required to absorb the radiation due to the indirect band gap of the material. The increased thickness leads to electron spreading due to the diffusion and this reduces the overall image characteristics of the device.

If one substitutes GaAs with InGaAs based compounds, one achieves a lower overall negative electron affinity characteristic. This characteristic is so low, that the photo response becomes negligible at high Indium concentrations. This effect may be due to the narrow band gap of the material in conjunction with the high electron affinity, or may just be due to the stoichiometry of the cesium oxide layer at the emission surface. In any event, direct substitution of the cathode material is not and has not been very successful.

The prior art concerning photocathodes show a wide variety of various techniques for extending the spectral range of the cathodes by utilizing multi-layer heterojunctions to compensate for the thickness, band gap, electron affinity, and activation characteristics of the different SWIR materials. Two of these SWIR cathode concepts that are disclosed are based on InP/InGaAs materials and transferred electrons. See for example, U.S. Pat. No. 5,047,821 issued to Costello, Spicer and Aebi in 1991. See also U.S. Pat. No. 6,121,612 issued to Sinor, Estrera and Couch in 2000. In both instances, the InGaAs is grown lattice matched to the InP material which is used as the emission material. In these instances, there is a compromise between electron affinity for material quality. By lattice matching the material, the interface between the InP and the InGaAs is of high quality, leading to low dislocation density and low recombination centers.

The lattice-matched material has a discontinuity in the conduction band which operate to block electrons from flowing from the narrow gap material into the emission material. To compensate for this the bias on the device must be large enough for the electrons to be thermionically emitted over the barrier. The required bias also introduces a field in the narrow gap material leading to enhanced recombination, mitigating some of the advantages of growing on lattice-matched materials. One other factor in common between cathode structures in the above-noted patents, is the formation of the emission contact. In both cases, the recommended emission surface contact is the cesiated silver layer. The silver is included to provide conductivity to bias the structure, while the cesium allows emission of electrons into a vacuum. A disadvantage of this layer is that photo generated electrons will not be blocked from entering the silver layer. These electrons are thus lost to the external circuit, and are not emitted to the vacuum for signal formation. While certain cathodes, as described in the above-noted U.S. Pat. No. 5,047,821, are commercially available, they exist only in an active configuration. There are other references which portray methods of adding biasing contacts on the emission surface of standard GaAs cathodes rather than the cesiated silver. For instance, layers of TiW overcoated with SiN have been used to provide addressable NEA cathode structures. The photocurrent is modulated by applying a voltage to the control electrodes.

In any event, the contact is operative to turn off electron emission rather than enhance it. As can be seen, the technique requires the deposition of a thick metal directly on the emission surface of the GaAs. Since the metal was in direct contact with the GaAs, the dark current of the cathode is relatively high and photo-generated carriers are lost to the metal.

In contrast, examination of U.S. Pat. No. 6,069,445 issued on May 30, 2000, to Arlynn W. Smith, one of the inventors herein, and is assigned to ITT Industries, Inc., the assignee herein. This patent depicts a photocathode device for use in an image intensifier of a night vision device. The photo emissive wafer includes a first contact disposed on a peripheral surface for electrically contacting the wafer. An annular shaped second contact is disposed on the emission surface of the wafer for enabling a potential difference to be applied across the wafer to facilitate the emission of photo-generated carriers from the emission surface. The active layer consists of GaAs doped to a concentration level of between $1\times10^{17}$ $cm^{-3}$ and $5\times10^{17}$ $cm^{-3}$ with the window composed of AlGaAs. In the U.S. Pat. No. 6,069,445 device, the photo-generated carriers are prevented from entering the second contact region of the device by the large blocking barrier provided by leaving the etch stop layer of the AlGaAs in place. The energy barrier created by the etch stop layer limits the dark current in the cathode to thermionic emission over the barrier. Therefore, photo-generated electrons are pushed towards the emission surface by the internal electric field created by the bias potential, but cannot enter the contact due to the large barrier from the material discontinuity. In this case, signal electrons are not lost to the bias contact as is the case for cesiated silver. Thus, the use of an AlGaAs blocking contact is described in U.S. Pat. No. 6,069,445.

It is therefore an object of the present invention to provide a novel cathode design, which expands the spectral range of current image intensification systems to the short wavelength infrared (SWIR) range of electromagnetic spectrum.

SUMMARY OF THE INVENTION

A novel cathode design is shown, which extends the spectral range of current image intensification systems to the short wavelength infrared (SWIR) range of the electromagnetic spectrum which is between 1.0 to 1.75 $\mu$m. The cathode design and structure has a high emission probability. The cathode structure is a heterojunction of GaSb and GaAs, the GaSb material is to absorb the radiation and the GaAs is for emission characteristics. Each layer has a doping profile, which are used to minimize the effects of band offsets at the heterojunction and to provide a nearly flat conduction band profile throughout the cathode structure. The condition of nearly flat conduction band is supplemented by the use of an additional contact at the emission surface of the cathode where a bias is applied. The use of insulating technology prevents photo-generated signal electrons from entering the contact, thereby assuring their emission from the surface and operative to maintain low dark current characteristics for the intensifier cathode. The resulting SWIR image intensifier has all the advantages of current image intensifiers in terms of resolution and gain, but has a low dark current characteristic.

DETAILED DESCRIPTION OF THE DRAWINGS

Figure 1:
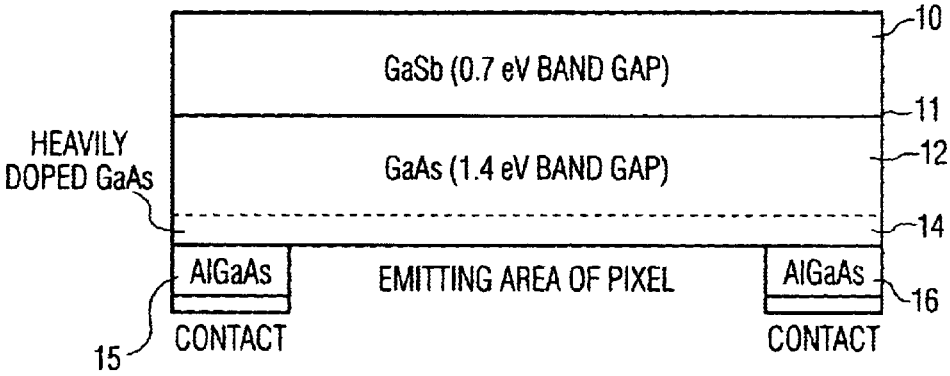
FIG. 1 is a schematic drawing of a pixel element in a SWIR cathode, according to this invention.

Referring to FIG. 1, there is shown a cathode structure according to this invention. As shown in FIG. 1, the cathode structure is a multi-layer structure consisting of a first layer 10 and a second layer 12, a layer 14 is heavily doped (10 times greater than the doping of layer 12) with respect to the doping of the remainder of layer 12 and first and second contacts 15 and 16. The GaAs layer 12 is doped between $1\times10^{17}$ $cm^{-3}$ and $5\times10^{17}$ $cm^{-3}$ which is relatively a low doping layer. The layer 10, as indicated, is GaSb, having a 0.7 eV band gap. The layer 10 is superimposed on layer 12, which layer is GaAs, having a band gap of 1.4 eV. The bottom portion of layer 12 is heavily doped GaAs and is shown as reference numeral 14. There is a dashed line to show that the bottom portion, which is the portion close to the contact area is heavily doped. Each of the contacts are blocking contacts as fabricated from AlGaAs. As one can see, contacts 15 and 16 exist on either side and are annular and are coupled to the GaAs layer 12. Each contact is a blocking contact as described, for example, in the above-noted reference U.S. Pat. No. 6,069,445, the entire specification of which is incorporated herein. The area between contacts 15 and 16 is designated as the emitting area of the pixel. This is the area where emission takes place. The layer 10 is selected for the SWIR material. This material is used in narrow band gap solar cells. For example, TPV cells, and has a constituent chemical of the GaAs. Other materials, such as InGaAs or InAs would not be suitable due to the large mismatch in both lattice constant and electron affinity leading to a large effective conduction band discontinuity and recombination centers. The values of electron affinity for layer 10, which is GaSb are nearly the same as for GaAs. This factor eliminates a conduction band discontinuity. A conduction band discontinuity impedes the flow of photo-generated electrons from the absorbent material to the GaAs. In any event, a conduction band discontinuity is compensated for with proper doping.

In the configuration shown as FIG. 1, electrons in the GaAs layer 12 diffuse towards the emission surface as electrons do in present photocathodes. With the application of sufficient bias on the contacts, these electrons are directly forced towards the emission surface. To ensure the highest emission probability, the emission surface of the GaAs layer 12 must be doped heavily of P type in nature, as indicated by layer 14, which is present at the front surface of the cathode. The doping is about 10 times that of the GaAs layer 12 or about $5\times10^{18}$ $cm^{-3}$. As seen, the area between contact 15 and 16 is designated by emitting area of the pixel. The heavy doping layer in the GaAs also serves the purpose of uniformly applying the bias to the SWIR absorbing material 10 (GaSb) and the intervening GaAs material 12. The heavy doping layer 14 also serves the purpose of an electron reflector, thereby creating a small electric field that pushes photo-generated electrons away from the front surface, where they would recombine and then be lost. It is noted that the structure in FIG. 1 has symmetry on both lateral sides and, of course, is not drawn to scale. The separation distance between contacts 15 and 16 is dictated by the level of P doping, as will be further explained.

Figure 2A:
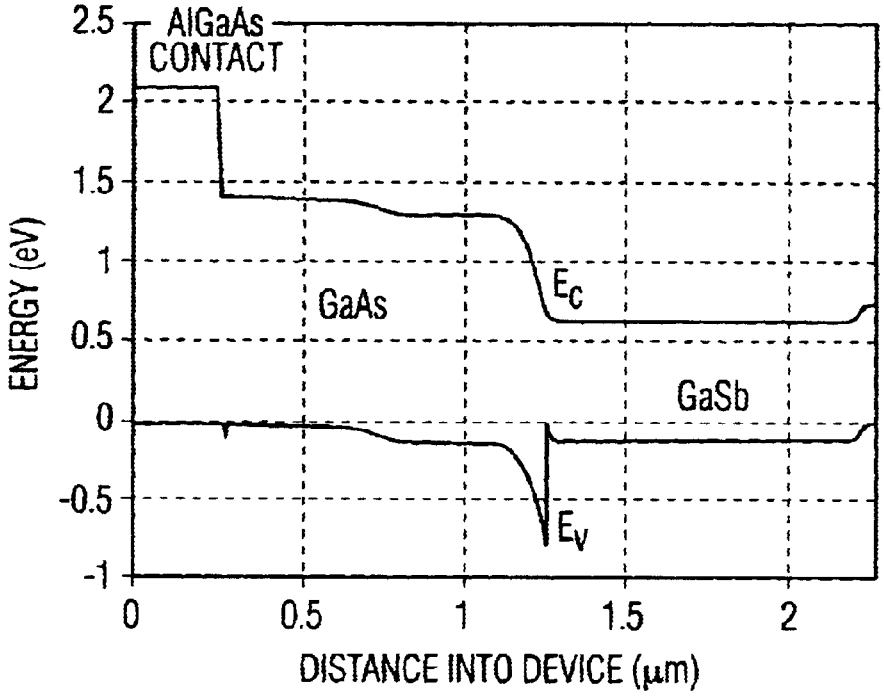
FIG. 2 consists of FIGS. 2A and 2B and shows energy band diagrams of the inventive cathode in the region of the emission surface and contacts.
Figure 2B:
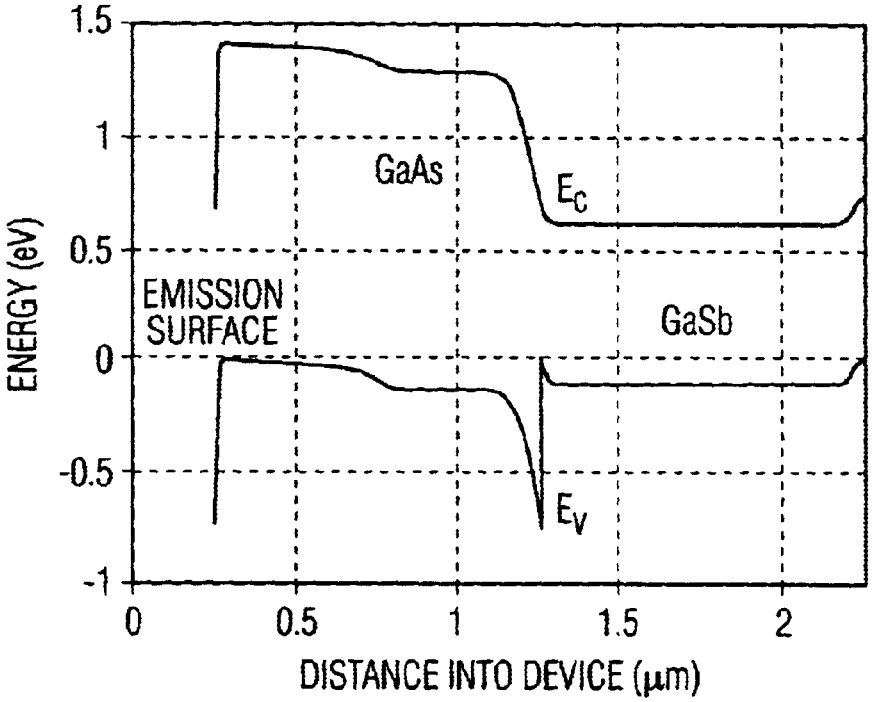

Referring to FIGS. 2A and 2B, areas of interest are the emission surface and the AlGaAs contact region. In the region of the emission surface, which is the area between contacts 15 and 16 of FIG. 1, the conduction band is bent downward with the application of the cesium oxide layer to make a negative affinity device. For the contact regions, the conduction band will rise due to the discontinuity between AlGaAs and the GaAs. During operation, the AlGaAs and contact metal is covered with an insulating material. This is not shown in the Figures, but the black area shown on the contacts as FIG. 1 is an insulating material. This insulating material can be silicon dioxide, silicon carbide, aluminum oxide or any other suitable insulator. The purpose of the insulating material is to prevent cesium oxide from producing electron emissions from these surfaces. The simulated electron band diagrams in equilibrium in the two areas of interest are shown in FIGS. 2A and 2B. Under the conditions, electron flow towards the emission surface is not permitted due to the conduction band barrier at the GaAs to GaSb heterojunction interface. This is the interface designated in FIG. 1 by line 11. This barrier which is the result of the difference in band gap.

Referring to FIGS. 2A and 2B, it is noted that all of the energy gap difference between the GaAs and GaSb is accounted for in the valance band. This is different than the case if InAs were chosen as the infrared absorbing material. In this instance, not only would there be a barrier due to the difference in band gap, but there would be an abrupt barrier due to a difference in electron affinities of the materials. There is a possibility of a small shift of the bands of GaSb towards the valance band of GaAs, and then a discontinuity will appear in the conduction band. The doping profile of the interface is adjusted to compensate for barriers up to 3 KT or approximately equal to 0.075 eV. This is basically shown on the diagrams of FIG. 2.

As previously stated, the emission surface is pulled to an N type condition by the application of the cesium oxide, it is further enhanced by the bias applied between the cathode and the MCP or microchannel plate in an image intensifier. An image intensifier will be shown with regard to FIG. 5 where the MCP is shown and positioned with respect to the photocathode. It is noted, referring to FIGS. 2A and 2B, that in the GaAs layer there is a shift in energy of both the conduction and valance bands. This shift is a result of the doping profile used throughout the region. The doping profile is required to smooth out the conduction band when a bias is applied to the AlGaAs contact. From the contact region, it can be seen that the conduction band has a discontinuity at the interface. FIG. 6 is an example of one doping profile in the GaAs/GaSb from the emission surface towards the SWIR material. The magnitude of the conduction band discontinuity between the GaAs and the AlGaAs is approximately 0.7 eV providing a large barrier to photogenerated electron flow from the GaAs to the contact metal. As long as the applied bias to the device does not cause band bending in the AlGaAs region, electrons will not be injected into the contact.

Figure 3A:
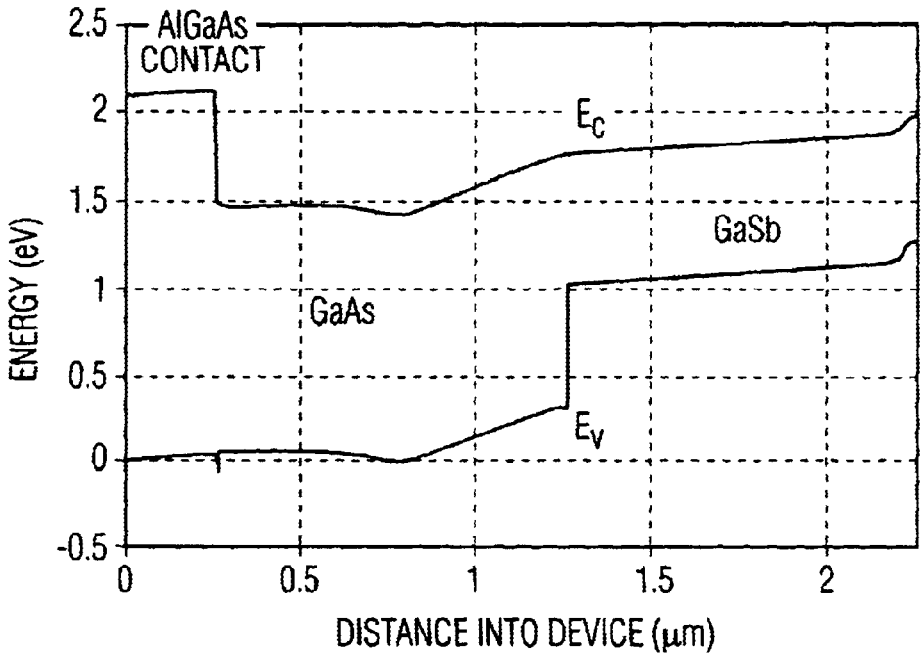
FIG. 3 consists of FIGS. 3A and 3B and depicts the energy band diagrams of the inventive cathode after a bias is applied to the contacts.
Figure 3B:
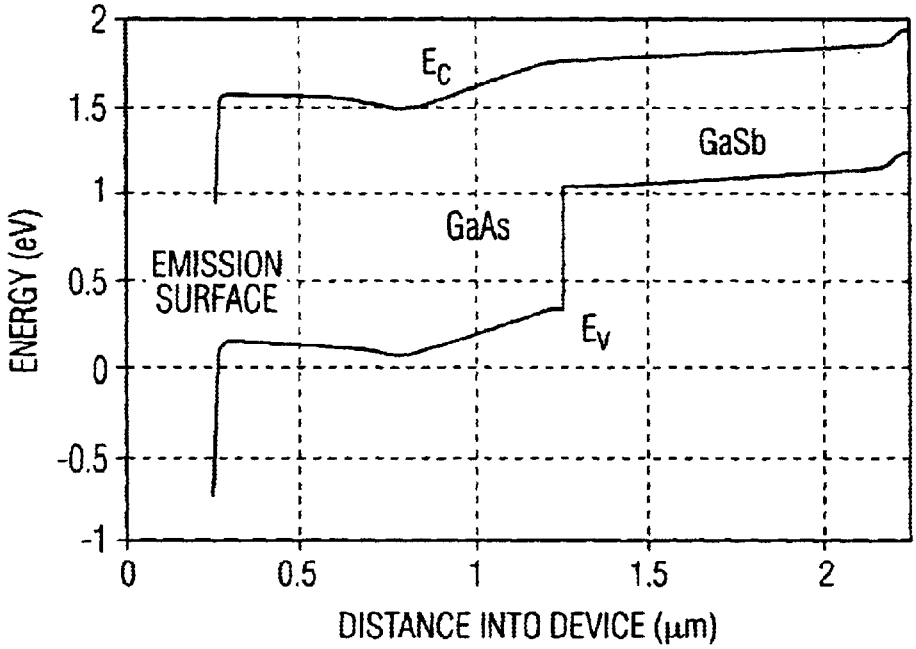

Referring to FIGS. 3A and 3B, there is shown the resulting energy band diagrams for a 1.25 volt bias applied to the AlGaAs contact, emission surface and contact regions. Applying a bias to the contact on the emission side of the device, leaving the front of the cathode grounded results in the shift of the energy bands. This shift again, is shown in FIG. 3. In FIGS. 3A and 3B, electrons will flow in the direction of the minimum conduction band. For example, they fall down the hill formed. Given this, it can be inferred that the small field due to the doping profile immediately pushes electrons created in the GaSb region away from the front surface of the device. The electrons will then diffuse towards the GaAs and are separated from the holes by a small applied field. The electrons experience a small drift towards the GaAs region, both the emission surface and the contact region. The conduction and valance bands are not bent in the narrow band gap material in order to minimize the recombination due to field effects. It is noted that there is no barrier to electron flow at the interface. In the description of the equilibrium case, if a small conduction band discontinuity is formed, doping can compensate for some of the blocking effects. In addition to conduction band discontinuity, there is a possibility of trapped charge at the interface leading to a charge barrier. The shape of the barrier is more triangular in nature and can be compensated for by doping profiles. As in the case of the equilibrium diagrams, all of the band gap discontinuity of the GaAs/GaSb interface is accounted for in the valance band. If the bands of GaSb are shifted down a discontinuity is formed in the conduction band. As indicated, doping profiles can be used to minimize the effect of any discontinuity less than 0.075 eV. If the barrier height exceeds 0.1 eV, much more complicated doping profiles are required to compensate for the barrier. Such structures are normally tuned to provide enhanced thermionic emission over the discontinuity or tunneling through the barrier. In either case, there is a loss in electron transmission into the GaAs lowering the overall efficiency of the structure. Once in the GaAs region, drift and diffusion moves the carriers towards the emission surface. At the emission surface, electrons are emitted to the vacuum by the same processes as being implemented in current technology. Close examination of the GaAs regions shows that there is a small barrier to electron flow in the conduction band of the GaAs, this is the result of an un-optimized doping profile. It should be noted that electrons in the GaAs above the blocking contact will be diverted around the contact to the emitting regions on either side.

Figure 4:
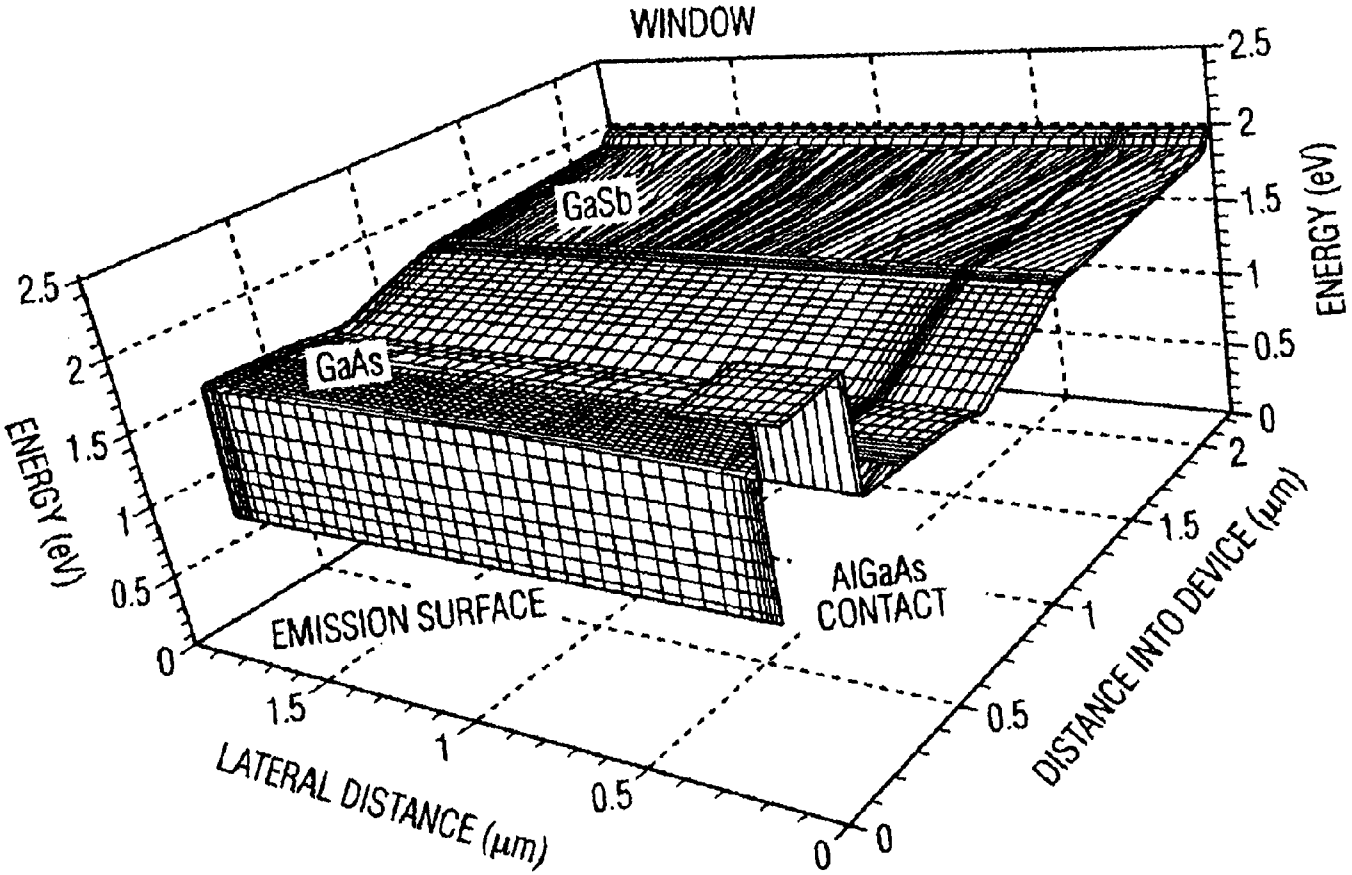
FIG. 4 is schematic representation depicting a portion of the conduction band diagram of the structure under bias conditions.

Referring to FIG. 4, a second characteristic of the structure depicted in FIG. 1 is shown. FIG. 4 depicts the two dimensional nature of the device. In FIG. 4, a portion of the conduction band of the structure under the previously discussed bias condition is shown. The condition to be aware of is that if the heavy doping of the emission surface were reduced in the conduction band, on the left side of the Figure would have been higher. This would force the electrons to drift towards the contact, producing an non-uniform emission characteristic. It is noted that the majority of the field is in the GaAs layer immediately adjacent to the GaSb layer. This field region draws the carriers from the GaSb towards the emission surface, limiting the amount of time the carriers are near the junction. Limiting the time near the heterointerface reduces the probability of recombination, again maintaining the signal. FIG. 4 shows the lateral distance plus the distance into the device in the Z direction, the energy in electron volts in the Y direction. There is shown the interface between the GaAs and the GaSb as well as the operation of the AlGaAs contacts.

Figure 5:
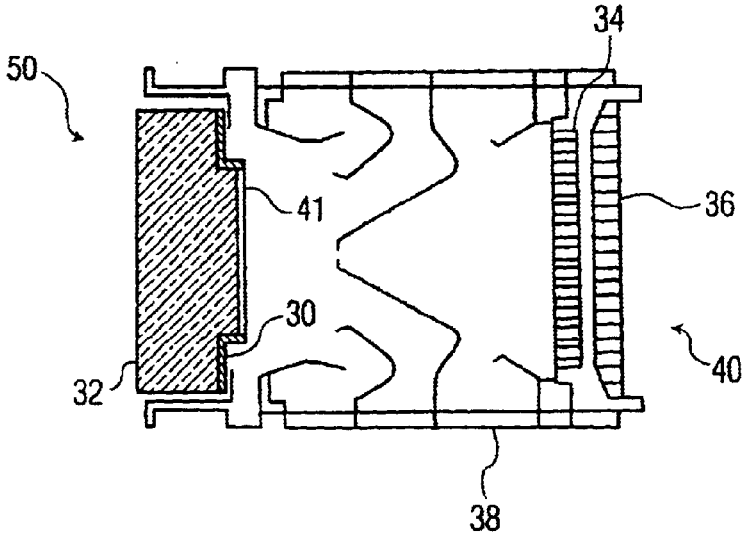
FIG. 5 is a sectional view of an image intensifier utilizing the cathode according to this invention.
Figure 6:
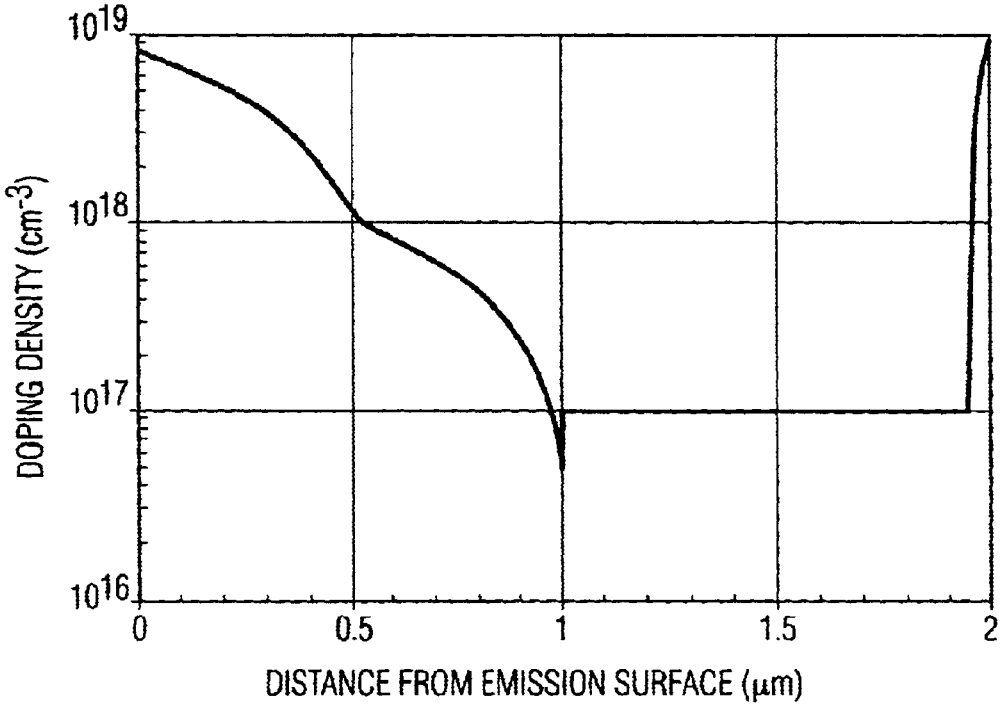
FIG. 6 is a doping profile through GaAs and GaSb.

FIG. 5 depicts a schematic diagram of an image intensifier tube, which utilizes a cathode as described above and other components as well. The image intensifier tube 40 conventionally includes a faceplate 32, which is one of three main components of the image intensifier 40. The other two components of the image intensifier 40 include an electron amplifier such as a microchannel plate 34 (MCP) and a phosphor screen 36, which is commonly referred to as the anode. It is the microchannel plate that receives a bias, as does the photocathode. The faceplate is used to minimize light scatter and stray light. The following references concern image intensifiers and the operation. U.S. Pat. No. 4,961,025 entitled, "Cathode for Image Intensifier Tube Having Reduced Veiling Glare" issued on Oct. 2, 1990 to Thomas et al. and assigned to ITT Corporation, the assignee herein. Normally the face plate 32, MCP 34 and phosphor screen 36 are assembled in an evacuated housing 38 using techniques as described in U.S. Pat. No. 4,999,211 entitled, "Apparatus and Method For Making a Photocathode" issued on Mar. 12, 1991 to Duggan and assigned to the assignee herein.

As seen in FIG. 5, the photocathode emissive layer is designated by reference numeral 41, and is the cathode which is shown, for example, in FIG. 1 and described above. The photo emissive wafer or photocathode is bonded to a face plate 32 using well known techniques, such as that taught in U.S. Pat. No. 5,298,831 entitled, "Method of Making Photocathodes For Image Intensifier Tubes" issued on Mar. 29, 1994 to Amith and assigned to ITT Corporation, the assignee herein. The photo emissive wafer 11 used in the present invention as indicated, is a multi-layer or laminar wafer which consists of a layer of GaSb deposited on a layer of GaAs, with the bottom portion of the layer of GaAs being heavily doped with two contacts 15 and 16. In any event, the structure of image intensifiers, including photocathodes fabricated from III–IV compounds is depicted in the above noted U.S. Pat. No. 6,069,445. That patent further shows an activating surface which includes cesium/cesium oxide and further shows annular shaped contacts of AlGaAs, which act as etch stop layers disposed on the interior of the emission surface of the wafer.

It should become apparent to those skilled in the art that there are many variations that can be made to the above-described embodiments, which would be functionally equivalent. All such modifications and variations are deemed to be included within the scope of the invention as defined by the claim appended hereto.

What is claimed is:

1. A cathode for an image intensifier device for extending operation of said device to the short wavelength infrared (SWIR) range of the electromagnetic spectrum, comprising:

a multi-layer structure having a first layer of a SWIR absorbing material with an integral second layer of GaAs, the interface between said layers forming a heterojunction, the exposed major surface of said GaAs layer being heavily doped as compared to the rest of said second layer, first and second blocking contacts disposed on said major surface and spaced apart, the space between said contacts creating an emitting surface area for said cathode when biased.

2. The cathode according to claim 1 when said first layer is fabricated from GaSb.

3. The cathode according to claim 2 wherein said first layer of GaSb has a 0.7 eV band gap with said second layer of GaAs having a band gap of 1.4 eV.

4. The cathode according to claim 1 further comprising at least one side transverse to said emitting surface area heavily doped as compared to the rest of said first layer to function as an electron reflector to create a small electric field that repels photogenerated electrons away from said transverse side.

5. The cathode according to claim 1 wherein said heavily doped portion is P type doping substantially greater than at least $5\times10^{17}$ $cm^{-3}$.

6. The cathode according to claim 1 wherein said blocking contacts are AlGaAs contact regions.

7. The cathode according to claim 6 wherein the magnitude of the conduction band discontinuity between said GaAs and said AlGaAs contact is about 0.7 eV providing a large barrier to photogenerated electron flow.

8. A cathode for operation in the short wavelength infrared (SWIR) region of the spectrum as encompassing the range of 1.0 to 1.7 $\mu$m, comprising:

a laminar semiconductor device having a first layer of GaSb deposited on a second layer of GaAs, said first layer having a band gap of 0.7 eV with said second layer having a band gap of 1.4 eV with the interface between said layers forming a heterojunction, said layer of GaAs having an emitting surface area, a first and a second blocking contact disposed on said emitting surface area to enable a bias to be applied to said cathode, said contacts fabricated from AlGaAs.

9. The cathode according to claim 8 wherein at least one surface of said layer of GaAs transverse to said emitting surface is heavily doped with said area of said emitting surface being also heavily doped and both having a doping level larger than the doping of the major portion of said layer of GaAs.

10. The cathode according to claim 9 wherein said layer of GaAs has a doping concentration of between $1\times10^{17}$ $cm^{-3}$ to $5\times10^{17}$ $cm^{-3}$ and said higher doping level is at least ten times greater than said doping concentration.

* * * * *